US005517922A

United States Patent [19]

Summa et al.

[11] Patent Number: 5,517,922

[45] Date of Patent: May 21, 1996

[54] POWER AND FREE CONVEYOR TRANSFER SYSTEM

[75] Inventors: Gareth D. Summa, Kansas City, Kans.; David L. Summa, Smithville, Mo.; Darrel Hespe, Olathe, Kans.; Gerard Schaller, Santenny; Thierry Jean-Amans, Torcy, both of France

[73] Assignee: Mid-West Conveyor, Inc., Kansas City, Kans.

[21] Appl. No.: 390,126

[22] Filed: Feb. 17, 1995

[51] Int. Cl.[6] ..... B61B 7/00

[52] U.S. Cl. ..... 104/172.3; 104/172.1

[58] Field of Search ..... 104/172.1, 172.2, 104/172.3, 172.4

[56] References Cited

U.S. PATENT DOCUMENTS

| | | | |
|---|---|---|---|
| 3,048,123 | 8/1962 | Burmeister et al. . | |
| 4,031,829 | 6/1977 | Bell et al. . | |
| 4,072,111 | 2/1978 | Hoehn . | |
| 4,223,610 | 9/1980 | Lempio . | |
| 4,354,435 | 10/1982 | Wakabayashi . | |
| 4,408,540 | 10/1983 | Dehne | 104/172.3 |
| 4,483,252 | 11/1984 | Pierson | 104/172.3 |
| 4,616,570 | 10/1986 | Dehne . | |

*Primary Examiner*—Robert J. Oberleitner
*Assistant Examiner*—C. J. Bartz
*Attorney, Agent, or Firm*—Litman, McMahon and Brown

[57] ABSTRACT

A power and free conveyor transfer system includes a number of drive trolleys operating within a free track and being selectively propelled by endless drive chains within a vertically aligned power track. Each drive trolley includes a trolley housing body to which are rigidly attached a pair of downwardly extending lateral arms, each with a rearward facing drive surface. A pivotable drive member is attached to the front end of the trolley housing and extends backward and downward between the lateral arms with a drive dog forming a portion thereof. The drive trolley design facilitates transfer of each drive trolley between non-synchronous delivering and receiving power tracks in a conveyor transfer zone. Within the transfer zone, the delivering and receiving power tracks are at different elevations and approach each other from a relatively large angle to minimize the potential for mechanical interference or jamming.

22 Claims, 6 Drawing Sheets

Fig.7.
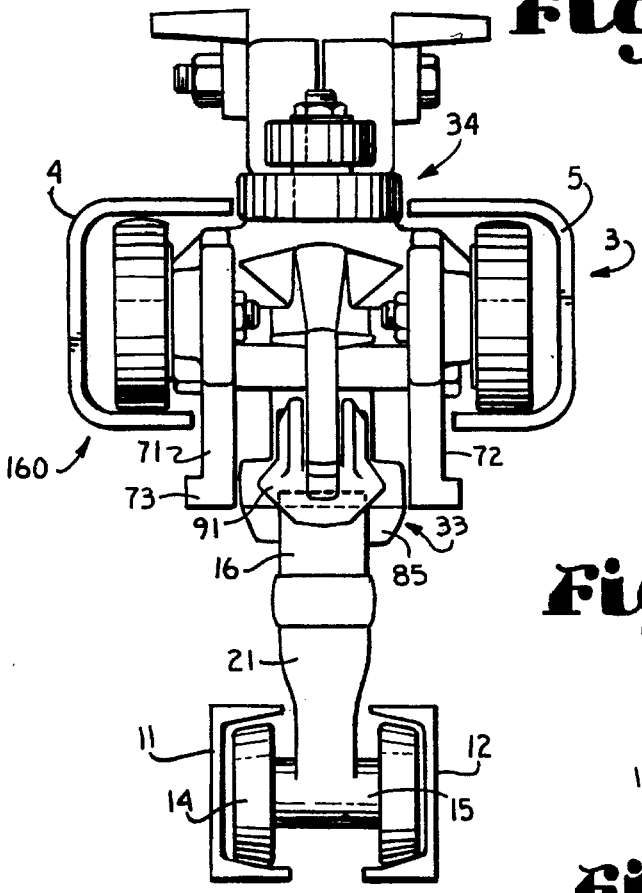
Fig.11d.
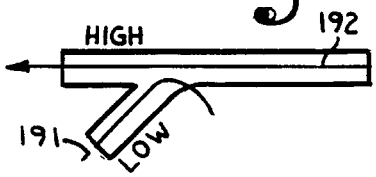
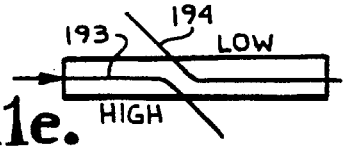
Fig.11e.
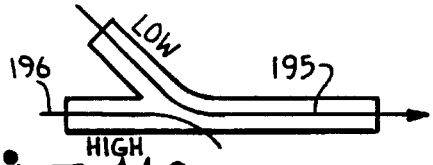
Fig.11f.
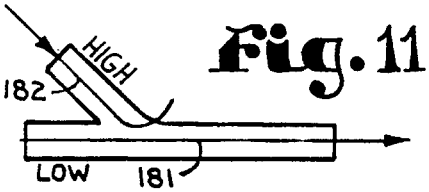
Fig.11a.
Fig.11g.
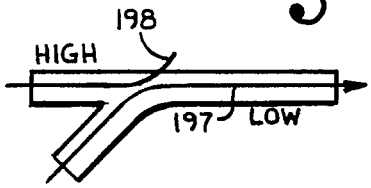
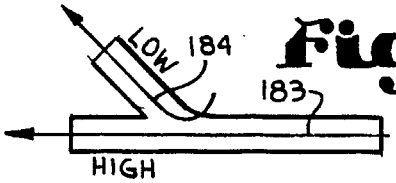
Fig.11b.
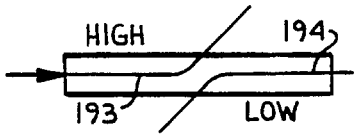
Fig.11h.
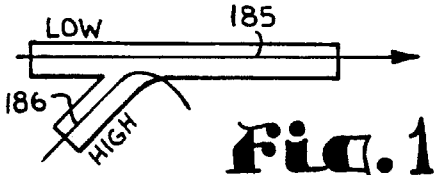
Fig.11c.

POWER AND FREE CONVEYOR TRANSFER SYSTEM

FIELD OF THE INVENTION

The present invention relates to a power and free conveyor transfer system and more particularly to such a system which includes an improved drive trolley and transfer zone configuration designed for facilitating operation within conveyor transfer zones.

BACKGROUND OF THE INVENTION

Power and free conveyor systems for moving bulky items through a manufacturing or assembly plant are well known. Such power and free conveyors include a "power" and a "free" conveyor track, generally disposed vertically with respect to each other. Operating within the power track is an endless drive chain with pusher members periodically attached to the chain and extending toward the free track. These pusher members are oriented to engage a drive dog or actuator on a drive trolley operating within the free track. While the pusher members are generally fixed in position relative to the drive chain, the drive dogs on the drive trolleys are typically selectively retractable.

The free track generally follows the same path as the power track(s) but is spaced vertically relative thereto. As originally implemented, power and free conveyor systems were suspension systems with loads suspended from trolleys or carriers operating in the free track and with the power track disposed above the free track. These suspension systems have reached a high degree of sophistication and can include features such as the ability to stop and accumulate free trolleys in specific accumulating areas and transfer zones which include intersections where loads can be transferred between non-synchronous conveyor systems.

More recently, in response to the specific requirements of the automobile industry, floor mounted or "inverted" power and free systems have been developed. In these inverted systems, the power track and the free track are disposed beneath the floor of the factory, with the free track positioned above the power track. A plurality of load carriages are attached to the free trolleys through a slot in the factory floor. Each load carriage is usually attached to two or more free trolleys with the load carriage being disposed above the floor and driven along the conveyor path by associated free trolleys.

These inverted systems have the capability of handling bulkier and heavier loads, such as automobile chassis, while minimizing many dangerous conditions found in suspension systems. For example, inverted systems allow workers to safely climb on and off of the load carriages and they eliminate the danger inherent in the swinging loads of suspension systems.

At the same time, the development of inverted systems has presented a new and unique series of problems to designers. In a large factory, a single power and free conveyor can run for a mile or more. Within the length of the conveyor are a myriad of different assembly stations, many of which operate at different speeds, and thus require different drive chains. A longstanding problem in the design of power and free conveyors is the transfer of trolleys between non-synchronous separate drive chains operating at different speeds while avoiding mechanical interference and resultant jamming of the drive chains and trolleys.

One approach to an inverted power and free conveyor design for facilitating transfer of trolleys between actuator drive chains is described in U.S. Pat. No. 4,616,570 to Dehne ("the '570 patent"). In the '570 patent, each drive trolley includes a holdback dog and a drive dog which form a portion of a driving actuator which is vertically movable between operative and non-operative positions. The driving actuator is biased to the operative position. The drive dog is a so-called "wide dog" design including a pair of wings extending substantially on either side of a center portion of the trolley. The holdback dog is spaced from the drive dog and is considerably narrower than the drive dog. Separate non-jamming cam surfaces are formed on the front edge of the drive dog, extending along the entire width of the wings, and the rear edge of the holdback dog such that actuators striking the cam surfaces from either direction cause the driving actuator to be driven toward the non-operative position, thus preventing the jamming of the drive trolley. When the drive trolley is being driven normally by a single drive chain, a drive member within the chain engages the drive trolley between the drive dog and the holdback dog and pushes or pulls the drive trolley, along with an attached automobile body carriage and other trolleys, along the conveyor path. The drive members are generally T shaped, but are much narrower than the wide dog drive dogs on the drive trolley. When the drive trolley is to be transferred between synchronous or non-synchronous power tracks at a transfer zone, two power tracks, i.e. both a "delivering" and a "receiving" power track, are positioned in parallel, side-by-side beneath the free track. Within the transfer zone, the receiving power track is positioned slightly lower than the delivering power track. With this arrangement, when a drive trolley enters a transfer zone, the pusher members on the delivering power track engage one wing of the wide dog drive dog while the pushing members on the receiving power track engage the opposite wing. With the receiving power track being positioned lower than the delivering power track, should there be a mechanical conflict between actuators on the two chains, the receiving pusher member will engage a cam surface on the drive dog wing, thus harmlessly pushing the driving actuator on the drive trolley upward and allowing the receiving actuator to pass beneath the drive dog. Meanwhile, the pushing member on the delivering power track, with its slightly elevated position, will remain engaged with its respective drive dog wing, thus continuing to push the drive trolley through the transfer zone. As the drive trolley nears the end of the transfer zone, the power tracks diverge, with the receiving power track being shifted into position in alignment with the free track as the delivering power track diverges from the free track until only the receiving actuators engage the drive trolley drive dog.

The system taught by the '570 patent works to prevent mechanical conflict in transfer zones within which power tracks can be oriented in parallel. However, to function properly, transfer zones in the '570 patent must include two power tracks arranged in parallel position for a considerable length, thus requiring relatively long transfer zones. Such long transfer zones are not always practical in factory designs where it is often desirable for the length of a transfer zone to be minimized. In such short transfer zones, the delivering and receiving power tracks often approach each other at a considerable angle and only encounter each other tangentially. In such a transfer zone, there is not enough interaction between the two power tracks to allow reliable transfer of a wide dog drive trolley.

It is clear then, that a need exists for an improved design for a power and free conveyor transfer system which allows drive trolleys to be reliably and efficiently transferred between different non-synchronous power tracks at a transfer zone. Such a system should achieve reliable and jam-free transfers between delivering and receiving power tracks in short transfer zones wherein the power tracks approach each other at a relatively large angle and encounter each other only tangentially in the transfer zone.

SUMMARY OF THE INVENTION

The present invention is directed to a power and free conveyor system in which power and free tracks are vertically aligned with one another. Both the power and free tracks are formed by continuous opposed U shaped channel members. An endless drive chain operates between the U shaped members of each power track, with a plurality of pusher members attached to the chain and extending toward the free track. Disposed for movement along the free track is a drive trolley conventionally supported by two pairs of wheels operating within the opposed U shaped channels forming the free track. The trolley wheels support a trolley housing body to which are rigidly attached a pair of lateral arms which extend toward the power track. Each lateral arm includes a rearward facing drive surface with a non-jamming cam surface. A pivotable drive member is attached to the front end of the trolley housing and extends rearward and downward between the lateral arms. The pivotable drive member includes a drive dog with a rear drive surface and a holdback dog extending rearward therefrom. The pivotable drive member is movable between an operative or drive position and a non-operative or accumulating position as it pivots relative to the trolley housing. In the drive position, the drive dog extends between and past the lateral arms to a position in which it is engageable by pusher members on the power track. In the accumulating position, the drive dog is pivoted upward and out of reach of the power track pusher members so that the drive trolley is disengaged with the power track. The holdback dog is pivotable with the pivotable drive member and also is pivotable relative to the drive member. The holdback dog includes a non-jamming cam surface on the rear end thereof and a hold surface on the front end thereof. The holdback dog thus will not interfere with power track pusher members moving in a direction toward the front of the drive trolley since they engage the cam surface and force it upward relative to the pivotable drive member, but will "hold back" the pusher members once they are engaged with the drive trolley as they encounter the forward facing hold surface. The pivotable drive member includes a forward-extending tongue which serves as an accumulating trigger. The tongue has an upward facing non-jamming cam surface. As the drive trolley encounters another trolley, or an accumulating cam within the free track, the tongue is forced downward by the contact between the other trolley or accumulating cam and the cam surface on the tongue, thus pivoting the rear of the pivotable drive member upward to push the drive dog and holdback dog out of reach of the power track pusher members.

The drive trolley design facilitates transfer of the drive trolley between different, angularly related, non-synchronous power tracks in a transfer zone. In such a transfer zone, the power track from which the drive trolley is being transferred will be called the delivering track and the power track to which the drive trolley is being transferred will be called the receiving track. Within the transfer zone, the delivering track is elevated slightly and the receiving track is lowered. As the drive trolley enters the transfer zone, it encounters the point at which the pusher and receiving power tracks are tangential with respect to each other (tangent point). At this point, the drive trolley is still being pushed by the delivering track. Since the delivering track is slightly elevated, its pushing members are at a height where they will engage the lateral arms on the drive trolley. By contrast, the lowered elevation of the receiving power track insures that its pusher members will pass beneath the lateral arms. Just past the tangent point in the transfer zone, the delivery power track begins to diverge from the free track path and the receiving power track begins to converge with the free track. As the delivery power track diverges, a pusher member engaged with the drive trolley slides outboard of the drive dog and the holdback dog and engages a non-jamming cam surface on the rear face of one of the lateral arms on the drive trolley. At the same time, the converging receiving power track pusher members slide beneath the opposite lateral arm and engage the lowest portion of the pushing face of the drive dog on the driving actuator. The receiving power track then becomes centrally aligned with the free track as the delivering power track diverges completely from the free track, and the receiving power track provides the sole pushing force past the transfer zone. Once the drive trolley is past the transfer zone, the receiving power track is elevated to a normal driving position relative to the free track. Thus, with the inventive power and free conveyor transfer system and method, no jamming or mechanical conflict occurs between pusher members on the delivering and receiving power tracks at the transfer zone tangent point since only the pusher members on the delivering track are in a position to engage the lateral arms on the drive trolley.

OBJECTS AND ADVANTAGES OF THE INVENTION

The principal objects of the present invention are: to provide an improved power and free conveyor transfer system; to provide such a power and free conveyor transfer system which includes transfer zones in which a drive trolley operating on a free track can be transferred between non-synchronous power tracks; to provide such a conveyor transfer system in which the transfer zones and drive trolleys are designed for transfer of drive trolleys between such non-synchronous power tracks without jamming or mechanical interference; to provide such a power and free conveyor transfer system in which the drive trolley includes fixed lateral arms extending on either side of a trolley housing; to provide such a drive trolley which includes a pivoting member attached to the trolley housing and extending between the lateral arms; to provide such a drive trolley in which the pivoting member includes a drive dog and a holdback dog which are selectively movable into and out of the path of a pusher member on a vertically aligned power track; to provide such a power and free conveyor transfer system in which transfer zones include delivering and receiving power tracks which encounter each other only tangentially with the receiving power track positioned somewhat further from the free track than the delivering power track in the transfer zone; to provide such a conveyor transfer system with a transfer zone in which, as the power tracks converge toward and then diverge away from each other, the delivering and receiving power tracks are at relative elevations such that the pushing members on the delivering power track engage the drive trolley via a lateral arm on one side while pushing members on the receiving power track engage only the drive dog on the drive trolley; and to provide such a power and free conveyor transfer system which is reliable and efficient and which is particularly well adapted for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 7 is a cross-sectional view of a portion of the transfer zone of FIG. 5 or 6, taken along line A—A of FIGS. 5 and 6, and illustrating a single power track in engagement with a drive dog of a drive trolley at a position just prior to, or just after the transfer zone of FIG. 5.

FIGS. 11*a*–11*h* are a plurality of schematic illustrations of other power and free conveyor transfer zone configurations in which the inventive drive trolley and transfer zone can be used effectively.

DETAILED DESCRIPTION OF THE INVENTION

Figure 1:
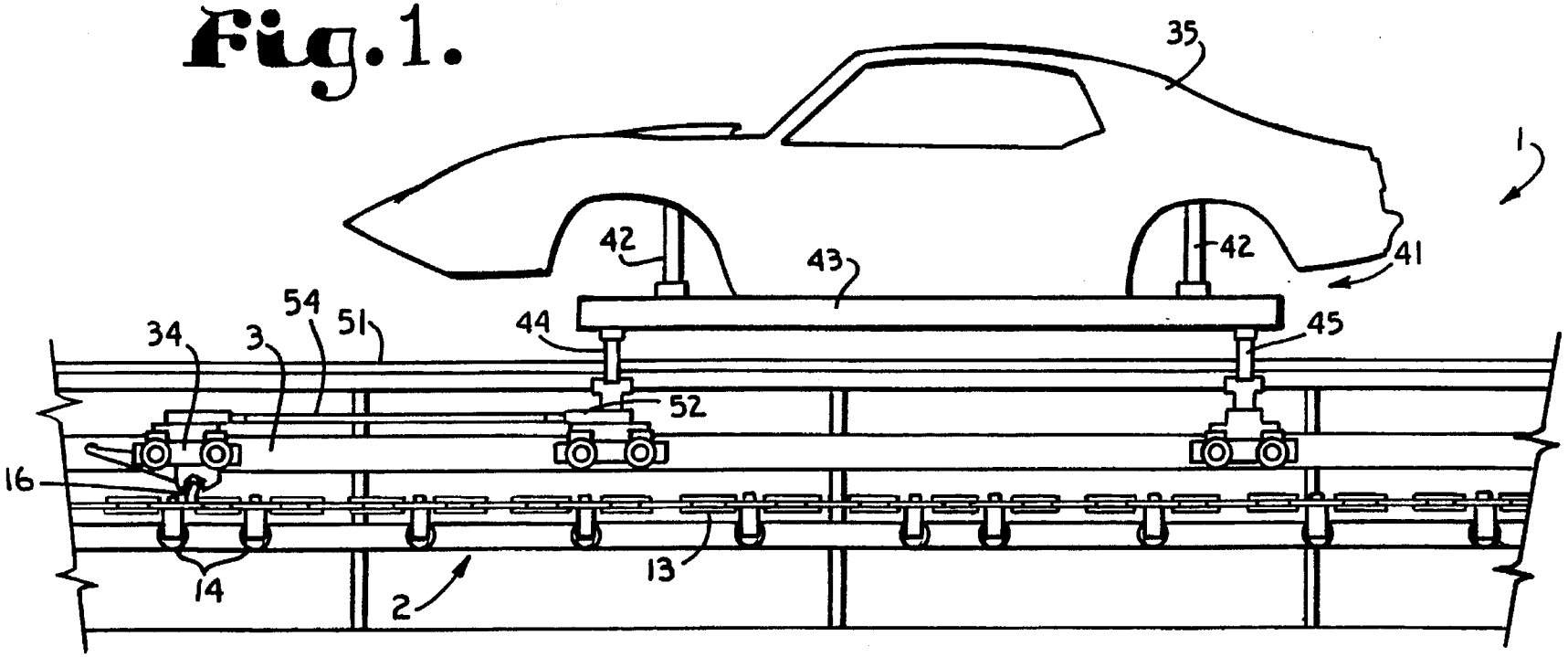
FIG. 1 is a partially schematic, side elevational view of an inverted power and free conveyor system in accordance with the present invention.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

I. Power and Free Conveyor System

Referring to FIGS. 1–4 and 7, the reference numeral 1 generally indicates a power and free conveyor system in accordance with the present invention. The conveyor system 1 is of the inverted type in which a power track 2 is positioned beneath and vertically aligned with a free track 3. The free track 3 is formed by a pair of opposed U shaped channel members 4 and 5 (FIG. 7) and the power track 2 is also formed by a pair of smaller U shaped channel members 11 and 12. An endless drive chain 13 is positioned within the power track 3 with a plurality of paired guide rollers 14 attached to respective axles 15 guiding the chain 13 within the channel members 11 and 12. A plurality of pusher members 16 are attached to the chain 13 at periodic intervals and extend upward therefrom toward the free track 3.

Figure 9:
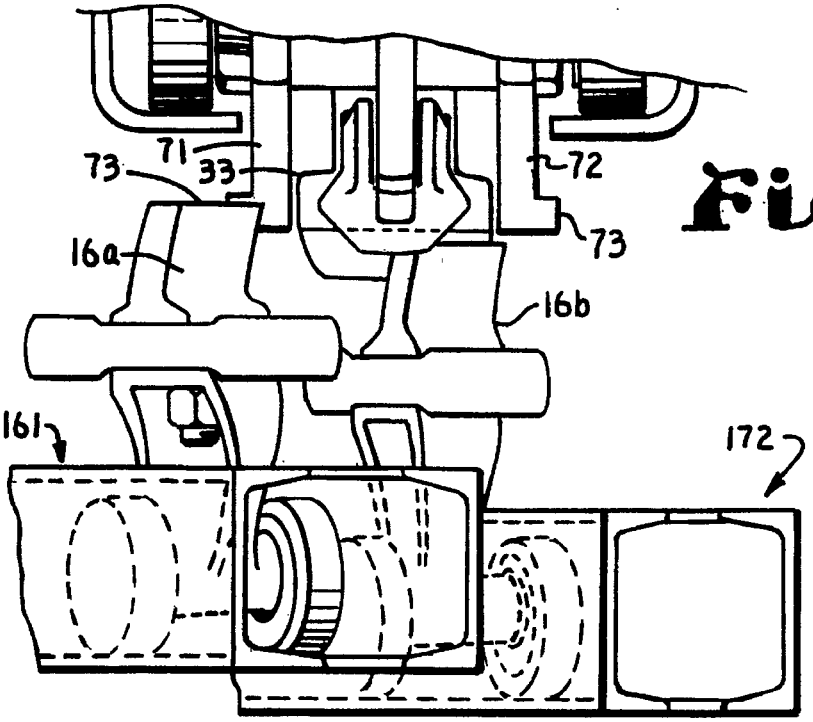
FIG. 9 is a cross-sectional view of a portion of the transfer zone of FIG. 6, taken along line C—C of FIG. 6, and illustrating an elevated delivering power track pusher member in engagement with a lateral arm of the drive trolley, and with a lower receiving track pusher member engaging the drive trolley drive dog.
Figure 10:
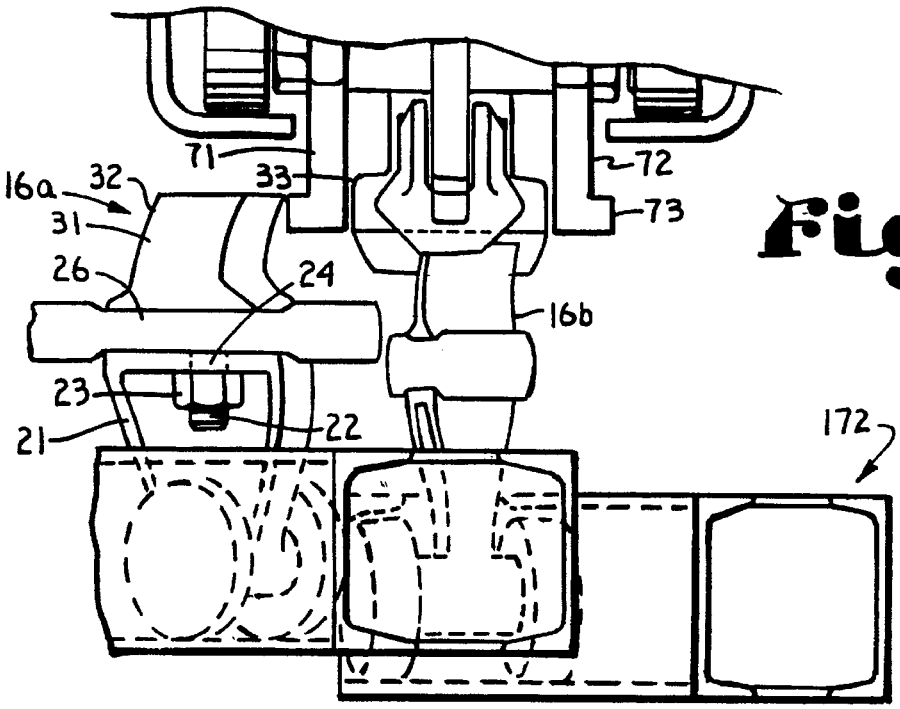
FIG. 10 is a cross-sectional view of a portion of the transfer zone of FIG. 6 with the transfer being complete, taken along line D—D of FIG. 6, and illustrating an elevated delivering power track pusher member leaving its engagement with a lateral arm of the drive trolley, and with a lower receiving track pusher member engaging the drive trolley drive dog.

Each of the pusher members 16 is attached to a respective upright bracket 21 via a threaded bolt 22 and nut 23 (FIGS. 9 and 10). Each bracket 21 is fixedly attached to a respective axle 15. Each bracket 21 includes a vertically oriented through bore 24 (indicated in dotted lines in FIG. 10) extending through an upper section 25 thereof for accepting the bolt 22. Each pusher member 16 includes a substantially horizontally oriented stabilizing base 26 and a substantially upright pushing projection 31. Each pushing projection 31 is tapered inward and rearward such that a front surface 32 forms a curved pushing surface for engaging a drive dog 33 in a drive trolley 34 operating within the free track 3, as explained below.

Referring to FIG. 1, an overall, partially schematic view of the conveyor system 1 illustrates a typical arrangement for conveying automobile bodies, such as the body 35, through an automobile assembly plant. The body 35 is shown attached to a carrier 41 via a plurality of support members 42. The carrier 41 includes a platform 43 to the bottom of which are attached a pair of vertical supports 44 and 45. Each vertical support 44 and 45 extends through a slot (not shown) in a factory floor 51. The vertical support 44 is connected to a front load carrying trolley 52 while the support 45 is connected to a rear load carrying trolley 53. The load carrying trolleys 52 and 53 also operate within the free track 3. The drive trolley 34 is connected to the front load carrying trolley via a tow bar 54. It should be noted that this configuration is merely illustrative, and that more, or fewer load carrying trolleys can be used to support the carrier 41, or the carrier 41 can be supported directly by the drive trolley 34.

Figure 2:
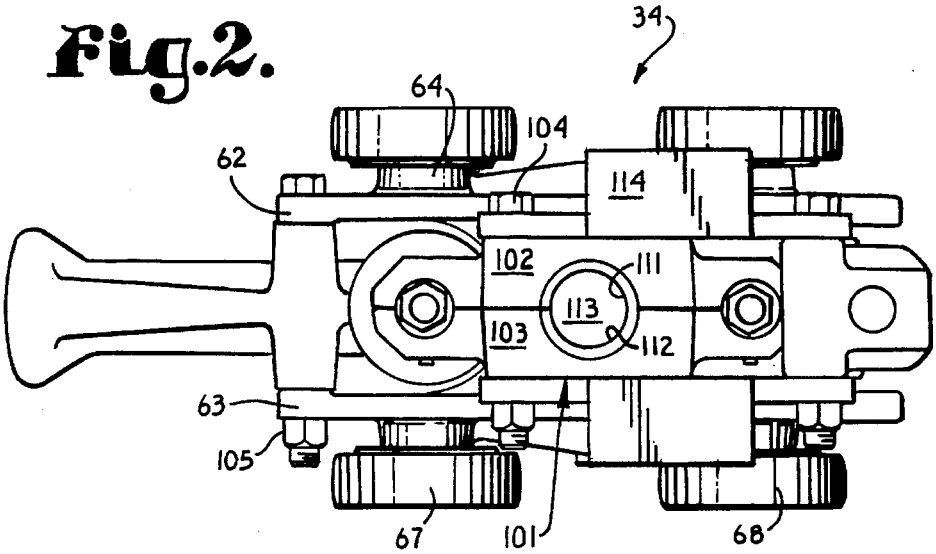
FIG. 2 is a top plan view of a drive trolley of the power and free conveyor system of FIG. 1.
Figure 3:
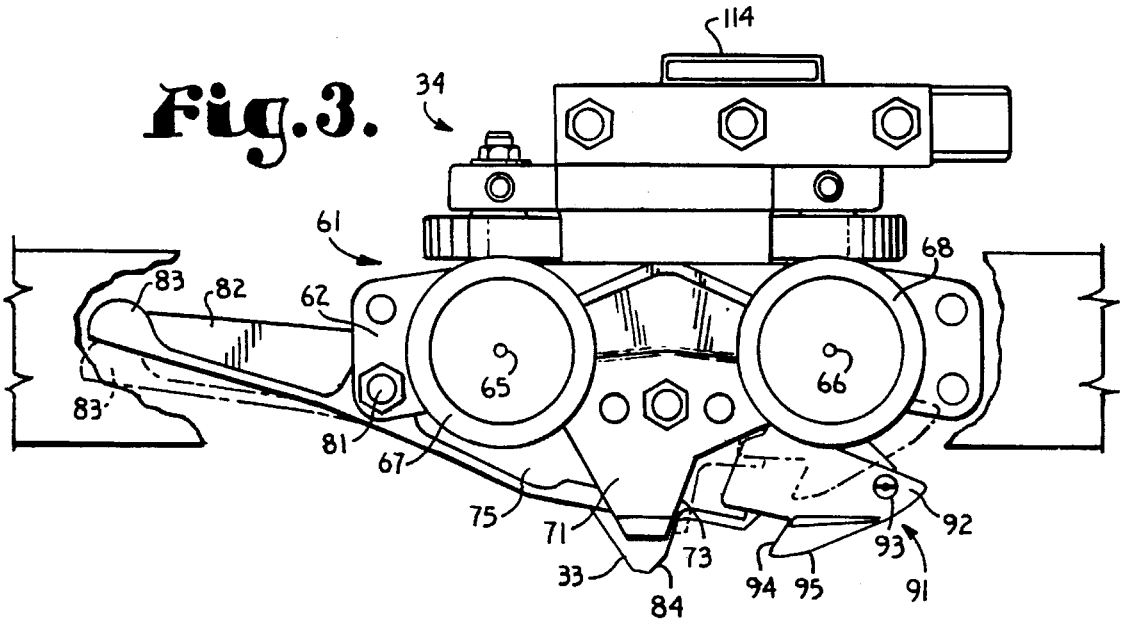
FIG. 3 is a side elevational view of the drive trolley of FIG. 2, operating within a free track and with portions of the free track broken away for illustration purposes.
Figure 4:
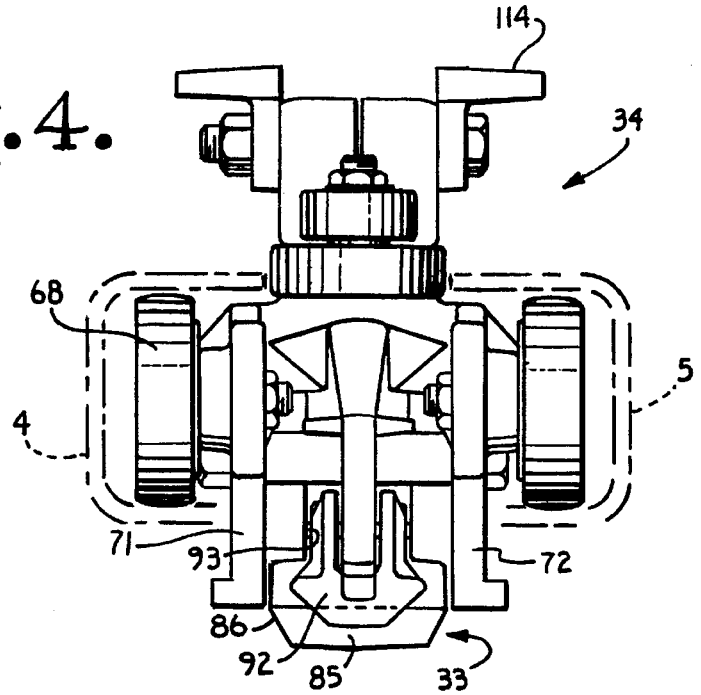
FIG. 4 is an end elevational view of the drive trolley of FIG. 2, operating within a free track and with opposing U-shaped channel members of the free track illustrated in broken lines.

The drive trolley 34 is illustrated in greater detail in FIGS. 2–4. The trolley 34 includes a trolley housing 61, which is made up of a pair of side plates 62 and 63. Each side plate 62 and 63 supports a pair of bearings 64 through which extend a pair of axles 65 and 66. Two pair of support wheels 67 and 68 are connected to the axles, with the wheel pairs 67 and 68 being sized and positioned to operate within the free track U-channel members 4 and 5. Each of the side plates 62 and 63 includes a downward extending lateral arm 71 and 72, respectively, which are L-shaped in cross-section, as shown in FIG. 4. As shown in FIG. 3, each lateral arm 71 and 72 presents an anti-jam cam surface on a rear, pusher engaging face 73 thereof.

The drive trolley 34 also includes the drive dog 33 which is attached to a pivotable drive member 75 extending between the side plates 62 and 63, and being pivotably attached thereto via a pivot bolt 81. As part of the pivotable drive member 75, a forward extending accumulating tongue 82 includes an upper cam surface 83. Referring to FIG. 3, the cam surface 83 is positioned to engage a mating accumulating cam, either fixed or on another trolley (not shown), within the free track 3 in the conveyor system 1 to thereby drive the accumulating tongue 82 downward, thus pivoting the drive dog 33 upward from a drive position, as shown in solid lines in FIG. 3, to an accumulating position, as shown in dotted lines in FIG. 3. In the accumulating position, the drive dog 33 is thus pivoted upward and out of range of the pusher members 16 on the power track 2. Once the accumulating cam surface 83 is removed from contact with the accumulating cam, the counterweight effect of the drive dog 33 tends to pivot the pivotable drive member 75 back downward to the drive position.

Referring to FIGS. 3 and 4, the drive dog 33 includes a rearward facing pushing surface 84 with a lower portion 85 shaped to present an anti-jam cam to a pushing member 16. The drive dog 33 also has outward extending portions 86 which extend substantially the entire distance between the lateral arms 71 and 72. When the pivotable drive member 75 is in the drive position, as shown in solid lines in FIG. 3, the lower portion of the drive dog 33 extends downward past the ends of the lateral arms 71 and 72.

Also attached to the pivotable drive member 75, and positioned behind the drive dog 33, is a holdback dog 91. The holdback dog 91 includes a pivot member 92 which is substantially U-shaped in cross section, as shown in FIG. 4. The pivot member 92 is pivotably attached to the rear of the pivotable drive member 75 via a pivot pin 93 such that it is pivotable between a holdback position, as shown in solid lines in FIG. 3, and a release position, as shown in dotted lines in FIG. 3. The holdback dog 91 includes a forward facing angled holdback surface 94, which, in the holdback position, is pivoted downward and into the path of a driving member 16, as shown in FIG. 7. In this position, a driving member 16 is trapped between holdback surface 94 of the holdback dog 91 and the drive dog 33 so that a driving member 16 is "held back" between the holdback dog 91 and the drive dog 33 during variations in speed between the drive trolley 34 and the drive chain 13.

The holdback dog 91 also includes a rearward facing cam surface 95 which, when encountered by a pusher member 16 moving from the rear of the drive trolley toward the front thereof, causes the pivot member 92 to be first driven upward to the release position and out of the path of the pusher member 16 so that it can proceed past the holdback dog 91 and engage the drive dog 33, thus subsequently allowing the pivot member 92 to pivot downward to the holdback position and capture the pusher member 16 between the drive dog 33 and the holdback dog 91, as explained above.

Attached to the top of the drive trolley 34 is a clamp 101, which includes a pair of plates 102 and 103 abutting each other and clamped together via a series of threaded bolts 104 and nuts 105. The plates 102 and 103 include semi-circular recesses 111 and 112, respectively, which, when the plates are clamped together, mate to form a circular aperture 113, which forms a clamping ring which can be varied in tension by tightening or loosening the nuts 105. The clamp 101 can be used to clamp the drive trolley 34 to a vertical support or to the tow bar 54, for example. A pair of outward extending wings 114 provide a triggering function for limit switches (not shown) positioned alongside the free trolley 2.

II. Transfer Zones

In a power and free conveyor system such as the one illustrated in FIG. 1, it is often necessary for carriers, such as the carrier 41, operating along the free track 3 to be switched or transferred between different, non-synchronous power tracks 2, with chains driven at different speeds. This is often due to a difference in the speed requirements of various assembly line procedures. Furthermore, in such conveyors 1, carriers, such as the carrier 41 must often be accumulated in an accumulation zone, or selectively switched between free tracks for a variety of reasons. Such transfers or selective switching occurs in a conveyor section known as a "transfer zone".

Figure 5:
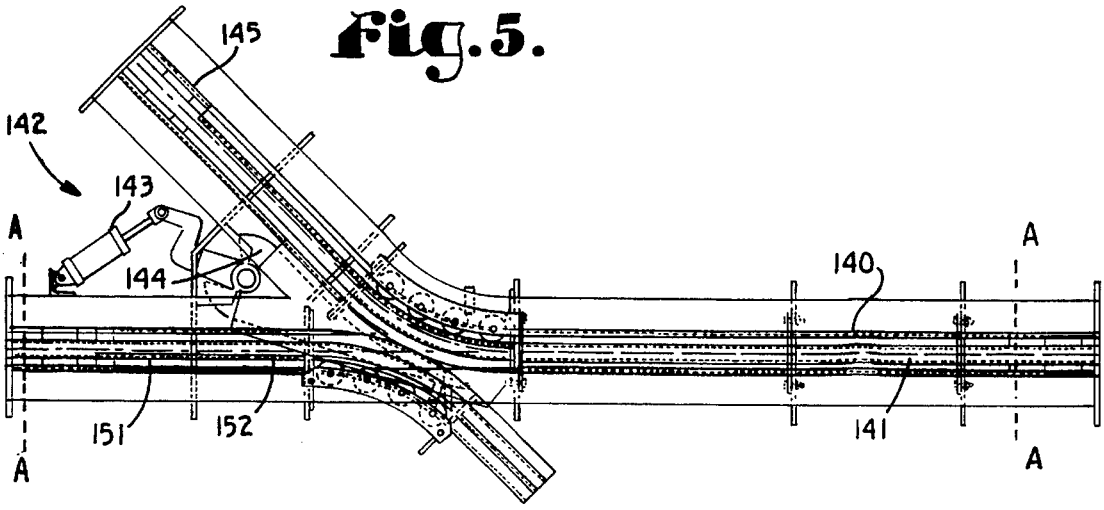
FIG. 5 is a top plan view of a transfer zone of the power and free conveyor of FIG. 1, in which the transfer zone is a right hand power on curve and switch.
Figure 6:
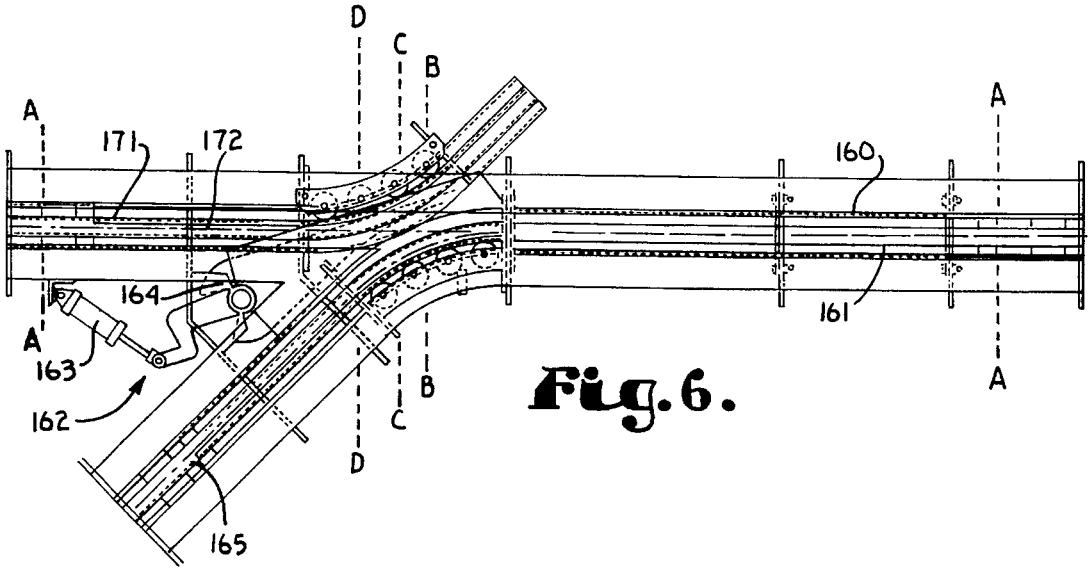
FIG. 6 is a top plan view of a transfer zone of the power and free conveyor of FIG. 1, in which the transfer zone is a left hand power on curve and switch.

FIG. 5 and 6 illustrate two examples of selectively switched transfer zones in greater detail. FIG. 5 is a power on curve right hand switch in which a free track 140 arrayed over a delivering power track 141 approaches a switch 142 from the right. The switch 142 includes a hydraulic actuator 143 which selectively pivots a directing plate 144 between a switched and a non-switched position. In the non-switched position, as shown, trolleys approaching on the free track portion 140 from the right via the power track 141 continue to be pushed by pusher members 16 in the power track 141 around the curve and toward the top left, as shown in FIG. 5, thus being propelled onto a free track portion 145. In the switched position, the actuator 143 pivots the plate 144 upward, thus causing trolleys approaching on the free track portion 140 from the right via the delivering power track 141 to continue straight onto a free track portion 151, to be intercepted and pushed by pusher members 16 in a receiving power track 152.

The transfer zone shown in FIG. 6 is a power on curve left hand switch in which a free track 160 arrayed over a delivering power track 161 approaches a switch 162 from the right. The switch 162 includes a hydraulic actuator 163 which selectively pivots a directing plate 164 between a switched and a non-switched position. In the non-switched position, as shown, trolleys approaching from the right on the free track portion 160, as propelled via the delivering power track 161 continue to be pushed by pusher members 16 in the power track 161 around the curve and toward the bottom left, as shown in FIG. 5, thus being propelled onto a free track portion 165. In the switched position, the actuator 163 pivots the plate 164 downward, thus causing trolleys approaching from the right via the power track 161 to continue straight onto a free track portion 171, to be intercepted and pushed by pusher members 16 in a receiving power track 172.

Now referring to FIG. 6, along with FIGS. 7–10, a transfer of a drive trolley 34 between the delivering power track 161 and the receiving power track 172 will be described.

FIG. 7 represents a cross-section, rear view of a drive trolley 34 operating at a point labeled as A—A in FIG. 6, within the free track portion 160 and being propelled by a pusher member **16*a* in the power track 161. As shown in FIG. 7, with portions of the drive dog 33 and the pusher member 16 shown in phantom lines behind the holdback dog 91, the power track 161 at the point A—A is at an elevation such that the pusher member 16 fully engages the drive surface 84 of the drive dog 33 above the lower non-jamming cam surface 85 and is at a level which is even with the non-jamming cam surfaces 73 of the lateral arms 71 and 72 of the drive trolley 34**.

Figure 8:
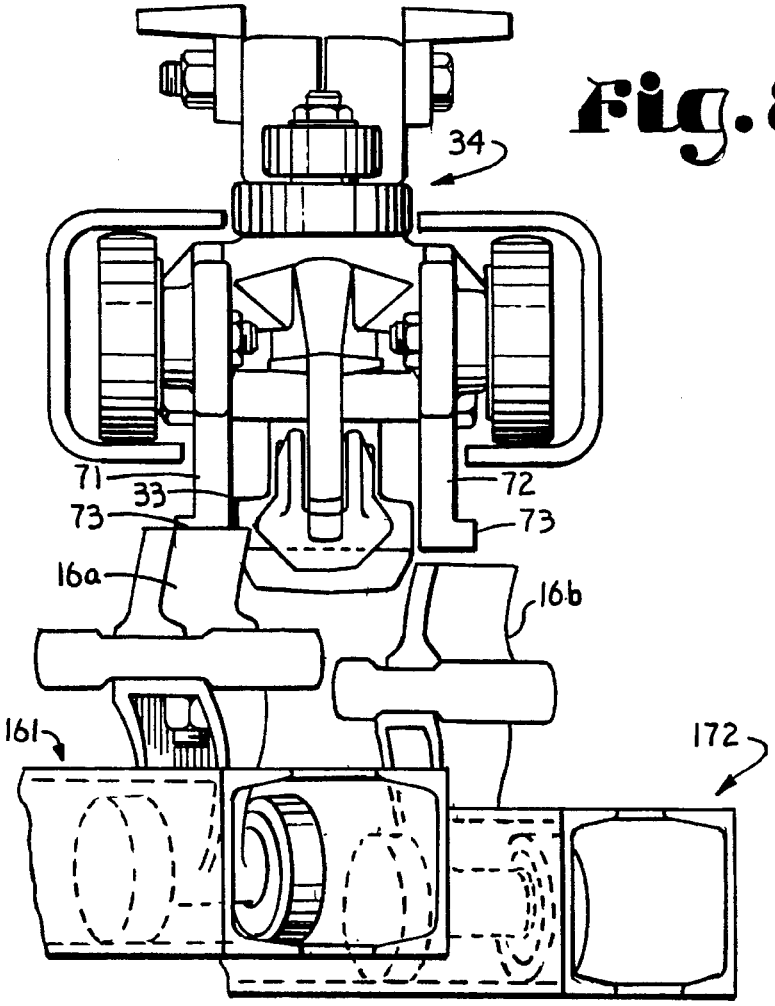
FIG. 8 is a cross-sectional view of a portion of the transfer zone of FIG. 6, taken along line B—B of FIG. 6, and illustrating an elevated delivering power track pusher member in engagement with a drive dog of a drive trolley and in transition between a drive dog and a lateral arm of the drive trolley, and with a lower receiving track pusher member passing beneath the opposite lateral arm just prior to engaging the drive trolley drive dog.

FIG. 8 represents a cross section view of the drive trolley 34 operating at a point labeled as B—B in FIG. 6, within the switch area of the transfer zone and with the receiving power track 172 approaching the switch area from the right as the delivering power track 161 starts diverging to the left. The receiving power track 172 is substantially lower in elevation than the delivering power track 161 such that a pusher member **16*b* in the receiving power track 172 passes beneath the cam surface 73 on the right lateral arm 72 of the trolley 34. By contrast, the pusher member 16*a* in the delivering power track 161 fully engages the drive dog 33 and, as it moves off to the left, also engages the cam surface 73 of the left lateral arm 71 of the drive trolley 34, thus continuing to propel the trolley 34** even as the delivering power track diverges to the left.

FIG. 9 represents a cross section view of the drive trolley 34 operating at a point labeled as C—C in FIG. 6, within the switch area of the transfer zone with the receiving power track 172 curving through the switch area as the delivering power track 161 continues to diverge farther to the left. At this point, the pusher member **16*b* in the receiving power track 172 has passed beneath the cam surface 73 on the right lateral arm 72 of the trolley 34 and has engaged the lower, non-jamming cam portion 85 of the pushing cam surface 84 of the drive dog 33 while the pusher member 16*a* in the delivering power track 161 has moved out of engagement with the drive dog 33 and is in full engagement with the cam surface 73 of the left lateral arm 71 of the drive trolley 34. At this point, either pushing member 16*a* or 16*b*, or both, if they happen to coincide in spacing, is in a position to propel the trolley 34**.

FIG. 10 represents a cross-sectional rear view of the drive trolley 34 operating at a point labeled as D—D in FIG. 6, within the switch area of the transfer zone with the receiving power track 172 beginning to straighten as it curves through the switch area as the delivering power track 161 diverges completely to the left. At this point, the pusher member **16*b* in the receiving power track 172 is in full engagement with the pushing cam surface 84 of the drive dog 33 while the pusher member 16*a* in the delivering power track 161 has moved out of engagement the cam surface 73 of the left lateral arm 71 of the drive trolley 34. At this point D—D, only the pushing member 16*b* is in a position to propel the trolley 34, and the transfer between the delivering power track 161 and the receiving power track 172** is essentially complete.

Finally, at the point labeled E—E in FIG. 6, the receiving power track 172 is fully straight and has been elevated to the position, again as shown in FIG. 7, such the pusher member 16 fully engages the drive dog 33.

Thus, with the inventive power and free transfer system, an interference free transfer of the drive trolley 34 is effected without mechanical interference between the delivering power track, such as the track 161, and the receiving power track, such as the track 172. At the same time, since the delivering and receiving power tracks approach each other at a relatively large angle and meet only briefly, tangentially in the transfer zone, the size and length of the transfer zone area is kept to a minimum.

Referring to FIGS. **11*a*–11*g*, a variety of other possible transfer zone configurations suitable for the inventive system and method are schematically represented. FIG. 11*a* represents a first power on straight right hand transfer zone in which a receiving power track 181 is powered through a straight zone on the right and a delivering power track 182 approaches and leaves the straight zone tangentially from the left and "wipes off" a trolley onto the straight receiving track 181. As noted on FIG. 11*a* (as in FIGS. 11*b*–11*h*), the receiving power tracks, such as the track 181, are indicated as "low", meaning that they are at an elevation at which the pusher members 16 will pass beneath the lateral arms 171 and 172 of a drive trolley 34. By contrast, the delivering power tracks, such as the track 182, are indicated as "high", meaning that the tracks are elevated slightly so that the pusher members 16 will engage the lateral arms 171 or 172 of the trolley 34 as it wipes the trolley 34 off onto the receiving track 181. Referring to FIG. 11*b*, a second power on straight right hand transfer zone is shown in which a delivering power track 183 passes through a straight zone while a receiving power track 184** curves tangentially into and away from the straight zone on the right side.

FIG. **11*c* represents a first power on straight left hand transfer zone in which a receiving power track 185 passes through a straight zone on the left while a delivering power track 186 curves through the transfer zone on the right. FIG. 11*d* represents a second power on straight left hand transfer zone in which a receiving power track 191 tangentially approaches and leaves a straight zone from the left while a delivering power track 192** passes through the straight zone on the right.

FIG. **11*e* and 11*h* represent in-line right and in-line left transfer zones, respectively, in which a delivering power track 193 approaches the transfer zone from a straightaway and then curves tangentially away, either right or left from a receiving power track 194** approaching from the opposite direction.

FIG. **11*f* represents a power on curve right hand transfer zone in which a receiving power track 195 passes approaches a straight zone from the left while a delivering power track 196** approaches the straight zone from a straightaway and curves away from the transfer zone to the right.

FIG. **11*g* represents a power on curve left hand transfer zone in which a receiving power track 197 passes approaches a straight zone from the right side while a delivering power track 198** approaches the straight zone from a straightaway and curves away from the transfer zone to the left.

In one embodiment of the invention, in a typical transfer zone such as that shown in FIGS. 5, 6, and **11*a*–11*h*, the receiving and/or delivering power track approaches and departs the transfer area at relatively high angle of incidence, e.g. between 30 and 50 degrees. This is done in order to shorten the transfer zone as much as possible and thereby limit the area in which mechanical conflict could occur between the delivering and receiving power tracks and the driving surfaces on the drive trolley 34**.

While the inventive power and free conveyor transfer system has been illustrated and described as being of the inverted type, it could readily be adapted to a conventional power and free system in which the power track is disposed vertically above the free track. In such a system, the drive trolley design would, of course, be inverted from the orientation illustrated herein.

It should be noted that the juxtaposition of pusher members **16*a* and 16*b* as shown in FIGS. 8, 9 and 10** is for illustration purposes only. In a typical transfer zone between non-synchronous power tracks, pusher members from both tracks would rarely be in such close proximity to each other.

It is to be understood that while certain forms of the present invention have been illustrated and described herein, it is not to be limited to the specific forms or arrangement of parts described and shown.

What is claimed and desired to be secured by Letters Patent is as follows:

1. In a power and free conveyor system comprising a free track with at least one transfer zone; a delivering power track following the path of said free track as it approaches said transfer zone and a receiving power track following the path of said free track as it leaves said transfer zone; said delivering and receiving power tracks being vertically spaced from said free track; a first endless drive chain operating within said delivering power track and a second endless drive chain operating within said receiving power track; each of said drive chains including a plurality of pusher members attached thereto and extending from said chain toward said free track; a drive trolley operably movable along said free track, said drive trolley comprising a trolley housing attached to and supported by wheels and a pivotable drive member movably attached to said trolley housing, said pivotable drive member including a drive dog with a rear facing drive surface; said pivotable drive member being movable between a drive position in which the drive dog is extended toward said power tracks and an accumulating position in which said drive dog is retracted away from said power tracks, the improvement wherein:

a. said drive trolley further comprises a first lateral arm fixedly attached to said trolley housing and extending toward said power tracks along a first side of said pivotable drive member, said first lateral arm having a rear facing drive surface; and wherein b. said drive dog of said pivotable drive member, when said pivotable drive member is in said drive position, is at an elevation at which it extends further toward said power tracks than said rear facing drive surface of said lateral arm.

2. A conveyor system according to claim 1, wherein:

a. said delivering power track and said receiving power track approach each other at an angle and encounter each other only tangentially within said transfer zone.

3. A conveyor system according to claim 1, and further comprising:

a. a second lateral arm fixedly attached to said trolley housing and extending toward said power tracks along a second side of said pivotable drive member and also having a rear facing drive surface.

4. A conveyor system according to claim 3, wherein:

a. said rear facing drive surfaces of said first and second lateral arms each include an anti-jamming cam surface.

5. A conveyor system according to claim 3, wherein:

a. each of said first and second lateral arms includes an outwardly extending leg with a rear surface of each of said legs forming a portion of the respective rear facing drive surface.

6. A conveyor system according to claim 3, wherein:

a. said rear facing drive surface of said drive dog includes a portion which includes a non-jamming cam surface.

7. A conveyor system according to claim 6, wherein:

a. said receiving power track and said delivering track are at different elevations within said transfer zone with said receiving power track being further from said free track than said delivering power track.

8. A conveyor system according to claim 7, wherein:

a. the relative elevations of said receiving power track and said delivering power track within said transfer zone insure that pusher members attached to said receiving power track will not engage the drive surface of either of said lateral arms within said transfer zone but will engage the drive surface of said drive dog while pusher members attached to said delivering power track will engage the drive surface of said lateral arms.

9. A conveyor system according to claim 7, wherein:

a. the elevation of said receiving power track within said transfer zone insures that pusher members attached to said receiving power track will engage only the non-jamming cam surface of said drive dog.

10. A conveyor system according to claim 1, said drive trolley further comprising:

a. a holdback dog attached to said pivotable drive member, said holdback dog being positioned behind said drive dog and being pivotable both with said pivotable drive member and with respect to said pivotable drive member.

11. A conveyor system according to claim 10, said holdback dog further comprising:

a. a front facing holdback surface and a rear facing anti-jamming cam surface whereby pusher members encountering said holdback dog from the rear of said drive trolley will cause the holdback dog to pivot upward relative to said pivotable drive member to allow passage of said pusher members while pusher members encountering said holdback dog from the front will be captured by said holdback surface.

12. A conveyor system according to claim 1, said drive trolley further comprising:

a. an accumulating tongue forming a part of said pivotable drive member and extending forward on said drive trolley, said accumulating tongue causing said pivotable drive member to pivot from said drive position to said accumulating position when said drive trolley encounters another trolley or other obstacle within said free track.

13. A conveyor system according to claim 12, said drive trolley further comprising:

a. an accumulating cam surface formed on said accumulating tongue in a position to urge said pivotable drive member from said drive to said accumulating position.

14. In a power and free conveyor system comprising a free track with at least one transfer zone; a delivering power track following the path of said free track as it approaches said transfer zone and a receiving power track following the path of said free track as it leaves said transfer zone; said delivering and receiving power tracks being vertically spaced from said free track; a first endless drive chain operating within said delivering power track and a second endless drive chain operating within said receiving power track; each of said drive chains including a plurality of pusher members attached thereto and extending from said chain toward said free track; a drive trolley operably movable along said free track, said drive trolley comprising a trolley housing attached to and supported by wheels and a pivotable drive member movably attached to said trolley housing, said pivotable drive member including a drive dog with a rear facing drive surface; said pivotable drive member being movable between a drive position in which the drive dog is extended toward said power tracks and an accumulating position in which said drive dog is retracted away from said power tracks, the improvement wherein:

a. said drive trolley further comprises:

i. a first lateral arm fixedly attached to said trolley housing and extending toward said power tracks along a first side of said pivotable drive member, said first lateral arm having a rear facing drive surface;

ii. a second lateral arm fixedly attached to said trolley housing and extending toward said power tracks along a second side of said pivotable drive member and also having a rear facing drive surface; and iii. said drive dog of said pivotable drive member, when said pivotable drive member is in said drive position, is at an elevation at which it extends further toward said power tracks than said rear facing drive surfaces of said first and second lateral arms, said rear facing drive surface of said drive dog including a portion which includes a non-jamming cam surface; and wherein b. said receiving power track and said delivering power track are at different relative elevations within said transfer zone such that pusher members attached to said receiving power track will not engage the drive surface of either of said lateral arms within said transfer zone but will engage the drive surface of said drive dog while pusher members attached to said delivering power track will engage the drive surfaces of said lateral arms.

15. A conveyor system according to claim 14, wherein:

a. said delivering power track and said receiving power track approach each other at an angle and encounter each other only tangentially within said transfer zone.

16. A conveyor system according to claim 14, wherein:

a. each of said first and second lateral arms includes an outwardly extending leg with a rear surface of each of said legs forming a portion of the respective rear facing drive surface.

17. A conveyor system according to claim 14, wherein:

a. said rear facing drive surfaces of said first and second lateral arms each include an anti-jamming cam surface.

18. A conveyor system according to claim 14, wherein:

a. the elevation of said receiving power track within said transfer zone insures that pusher members attached to said receiving power track will engage only the non-jamming cam surface of said drive dog.

19. A conveyor system according to claim 14, said drive trolley further comprising:

a. a holdback dog attached to said pivotable drive member, said holdback dog being positioned behind said drive dog and being pivotable both with said pivotable drive member and with respect to said pivotable drive member.

20. A conveyor system according to claim 19, said holdback dog further comprising:

a. a front facing holdback surface and a rear facing anti-jamming cam surface whereby pusher members encountering said holdback dog from the rear of said drive trolley will cause the holdback dog to pivot upward relative to said pivotable drive member to allow passage of said pusher members while pusher members encountering said holdback dog from the front will be captured by said holdback surface.

21. A conveyor system according to claim 14, said drive trolley further comprising:

a. an accumulating tongue forming a part of said pivotable drive member and extending forward on said drive trolley, said accumulating tongue causing said pivotable drive member to pivot from said drive position to said accumulating position when said drive trolley encounters another trolley or other obstacle within said free track.

22. A conveyor system according to claim 21, said drive trolley further comprising:

a. an accumulating cam surface formed on said accumulating tongue in a position to urge said pivotable drive member from said drive to said accumulating position.

* * * * *